US005265406A

United States Patent [19]

Hofmann et al.

[11] Patent Number: 5,265,406

[45] Date of Patent: Nov. 30, 1993

[54] OPEN-END SPINNING DEVICE

[75] Inventors: Eberhard Hofmann; Johann Pohn, both of Ingolstadt, Fed. Rep. of Germany

[73] Assignee: Schubert & Salzer Maschinenfabrik AG, Ingolstadt, Fed. Rep. of Germany

[21] Appl. No.: 927,885

[22] Filed: Aug. 10, 1992

Related U.S. Application Data

[63] Continuation of Ser. No. 665,971, Mar. 7, 1991, abandoned.

[30] Foreign Application Priority Data

Mar. 9, 1990 [DE] Fed. Rep. of Germany ..... 4007517

[51] Int. Cl.[5] ..... D01H 4/40

[52] U.S. Cl. ..... 57/417

[58] Field of Search ..... 57/417, 400, 404, 406, 57/408, 413, 414, 415, 416

[56] References Cited

U.S. PATENT DOCUMENTS

| | | | |
|---|---|---|---|
| 3,640,061 | 2/1972 | Landwehrkamp | 57/417 |
| 3,696,604 | 10/1972 | Nozaki et al. | 57/417 |
| 4,068,456 | 1/1978 | Landwehrkamp | 57/417 |
| 4,385,488 | 5/1983 | Raasch et al. | 57/417 |
| 4,516,397 | 5/1985 | Raasch et al. | 57/417 |
| 4,773,211 | 9/1988 | Stahlecker et al. | 57/417 |
| 4,854,119 | 8/1989 | Stahlecker et al. | 57/417 |

FOREIGN PATENT DOCUMENTS

| | | | |
|---|---|---|---|
| 2544721 | 10/1975 | Fed. Rep. of Germany . | |
| 3016675 | 11/1981 | Fed. Rep. of Germany . | |
| 250237 | 10/1987 | Japan | 57/417 |

*Primary Examiner*—Joseph J. Hail, III

*Attorney, Agent, or Firm*—Dority & Manning

[57] ABSTRACT

In an open-end spinning device a yarn draw-off nozzle suitable to ensure constant spinning conditions even at very high rotational speeds is provided. This is achieved in that the yarn draw-off nozzle is designed so as to be especially capable of heat dissipation and thus being capable of preventing a heat accumulation in the area of the yarn draw-off nozzle thanks to its high capability of heat dissipation.

7 Claims, 1 Drawing Sheet

OPEN-END SPINNING DEVICE

Figure 1:
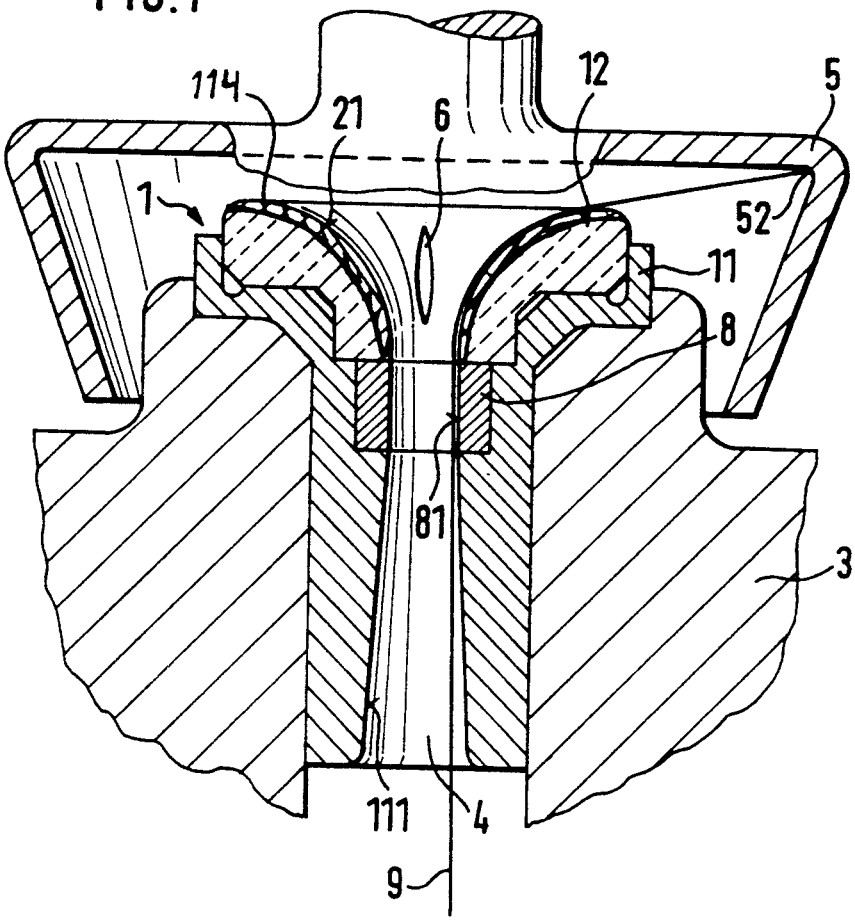

This is a continuation of application U.S. Ser. No. 07/665,971 filed Mar. 7, 1991, which was abandoned upon the filing hereof.

The instant invention relates to an open-end spinning device with a yarn draw-off nozzle.

It is known from DE-OS 25 44 721 that yarn draw-off nozzles of open-end spinning devices made of wear-resistant materials can be used because of the unacceptable wear caused by the running yarn in order to achieve longer life of the device and better, constant spinning conditions.

DE-PS 30 16 675 has also proposed to provide open-end spinning devices with draw-off nozzles the upper surfaces of which were rendered wear resistant by coating them.

As the operating speeds of rotors have increased, difficulties have arisen in spinning due to increased frequency of yarn breakage, soiling of the draw-off nozzles and also increased wear of same. These difficulties have been countered by special design of the yarn draw-off nozzle in order to achieve better propagation of the twist to the point of incorporation as it was thought that these occurrences of yarn breakage were due solely to insufficient propagation of twist in the fiber ring. These measures have resulted in increased strain of the yarn draw-off nozzle, no longer due only to increased speeds. To counteract the wearing of draw-off nozzles, in particular with certain synthetic materials and reviving processes, the yarn-guiding parts were rendered wear-proof by inserting a ceramic insert into the yarn draw-off nozzle which was made otherwise of hardened steel or steel capable of being hardened. This made it possible to increase the life of the nozzles and thereby to improve the exergy of these yarn draw-off nozzles.

Surprisingly it then appeared that it was not only the propagation of the twist which influenced yarn quality in the presence of this increased yarn breakage and difficulties in spinning, but that the cause for these is an inadmissible temperature rise occurring at the yarn draw-off nozzle. This inadmissible temperature rise is caused by the fact that the heat produced by friction of the yarn is not sufficiently dissipated so that an accumulation of heat occurs.

This heat accumulation attacks the yarn, the reviving layer is removed from the individual fibers of the yarn running through the hot draw-off nozzles and the fibers lose their protective layer. As a result, uneven yarn is produced and yarn breakage occurs often, not only during spinning but also during further processing. Furthermore the increased abrasion in the area of the draw-off nozzle soils the yarn-guiding surfaces, and this also leads to yarn breakage and thus to unnecessary production outages. Without thorough cleaning of the yarn draw-off nozzle it is generally impossible to resume spinning, not to mention that this increased temperature represents a danger for the synthetic fiber material to melt.

The instant invention is now based on the realization that an accumulation of heat is produced in the area of the yarn draw-off nozzle, in particular due to the wear-resistant design of same, said heat accumulation negatively affecting the overall spinning process and the formation of the yarn.

It is therefore the object of the instant invention to avoid these disadvantages. This object is attained through the characteristics of this invention. The novelty and invention is the realization that a heat problem occurs on the yarn draw-off nozzle, influencing the yarn and thereby the spinning capability.

By designing the yarn draw-off nozzle so as to be capable of dissipating heat a heating up of the yarn draw-off nozzle and the occurrence of the above-mentioned interferences is avoided.

An advantageous, long-life and wear-proof design consists in attaching yarn-guiding surfaces made of wear-proof materials to the base body. It is especially advantageous for the base body to be made of highly heat-conducting materials such as aluminum or zinc. Other materials and alloys with great heat conductivity are of course also suitable. These materials are furthermore well suited to be produced economically, at very low cost.

A nearly optimal heat dissipation from the draw-off nozzle into the environment is achieved if no insulating medium is present between the base body of the yarn draw-off nozzle and the continuing spinning chamber cover.

It is furthermore advantageous in a yarn draw-off nozzle which is designed so as to taper away from the spinning element for an insert made of hard steel to be provided in the tapered (and essentially cylindrical) part of the yarn draw-off nozzle pointing away from the spinning chamber, said insert combining within itself the advantages of wear resistance and those of heat conductivity. The yarn running through the draw-off nozzle touches the cylindrical portion of the surface with a pressure that is known to be considerably lower than with a funnel-shaped one. A wear resistance of the material of the yarn draw-off nozzle that is lower than with ceramic material can therefore be sufficient at this point.

Additional characteristics and advantages of the invention are derived from the following description and embodiments shown in the drawings.

Figure 2:
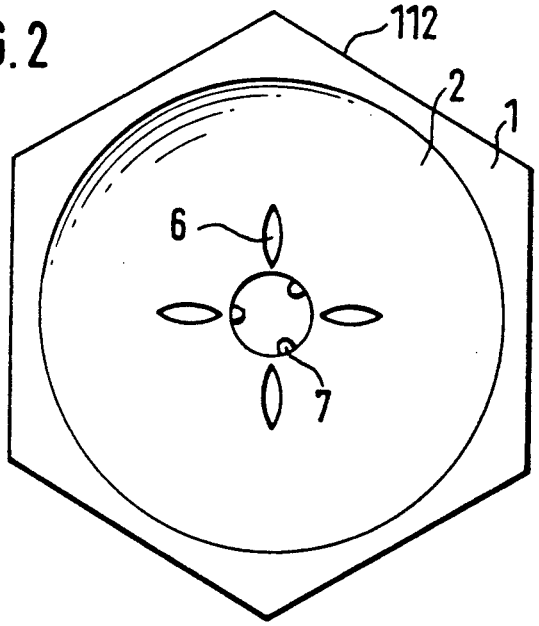

FIG. 1 shows a partial section of an embodiment of the device according to the invention in the area of the yarn draw-off nozzle and FIG. 2 shows a top view of the draw-off nozzle shown in FIG. 1.

The open-end spinning device shown in FIG. 1 consists of a rotor 5 which is nearly centered as it extends into a mushroom-shaped protuberance of the rotor cover 3 containing the yarn draw-off nozzle 1. The rotor 5 is surrounded by a rotor housing (not shown) which is normally sealingly closed by a cover (here the rotor cover 3) and which is subjected to negative pressure during the spinning process. The fibers going through the fiber feeding channel (not shown) into rotor 3 are conveyed into the rotor groove 52 under the influence of their kinetic energy and the forces prevailing in the rotor, are there spun into a yarn 9 and are drawn off from rotor 5 and conveyed through the yarn draw-off channel 4 to a storage device (not shown).

In the example shown here, the yarn draw-off nozzle 1 is attached with its base body 11 by usual means (not shown here) in the part of yarn draw-off channel 4 away from the rotor 5 which is located in the rotor cover 3. When sufficient appropriate contact exists between base body 11 and rotor cover 3, the yarn draw-off nozzle can also be provided with threads and can be screwed into rotor cover 3.

The surface 111 of the yarn draw-off nozzle 1 turned to the inside of the yarn draw-off channel 4 extends in yarn draw-off direction in the embodiment shown in FIG. 1, widens in the manner of a cone, but may also be essentially cylindrical in form. The surface 111 may be optionally provided with a wear-proof coating 114.

The funnel-shaped outlet piece 12 of the yarn draw-off nozzle 1 is set on the base body 11 of the yarn draw-off nozzle 1 and points in the direction of the rotor 5. This outlet funnel 12 may be made of a ceramic material and be polished on the surface 21 of its outlet. When the yarn 9 is now drawn off from rotor 5 in the operational spinning process and is guided in part over the surfaces 21 and 111, the friction which acts between yarn 9 and the surfaces touched by yarn 9 produce then a high degree of heating of the surfaces that would degrade the spinning process within a short period of time if the temperature were not kept below values that are advantageous for spinning conditions by the heat dissipation made possible by the high degree of heat conductivity of the base body 11.

The mutually close contact between the interacting components of outlet piece 12, base body 11 and rotor cover 3 shown in FIG. 1 ensures optimal heat dissipation between the areas of the yarn draw-off nozzle 1 which are heating up and the rotor cover 3, and from there into the environment. The mass of the rotor cover 3 which is much greater than that of the yarn draw-off nozzle 1 dissipates the heat to be dissipated into the environment. Stable and constant spinning operation is thereby made possible. Soiling of the surfaces 21 and 111 and the yarn breakage this causes are avoided. Following yarn breakage for any other reason, piecing which requires the constant condition of the surface of the yarn draw-off nozzle 1 is made possible without any problems and is not disturbed by dirt.

The base body 11 of yarn draw-off nozzle 1 which is produced by casting, die-casting or machining is made of a material possessing a high degree of heat conductivity lambda, whereby values of lambda $>80$ W/mK are to be preferred. But lower values of lambda may be sufficient for the required heat dissipation, depending on the rotational rotor speed and the properties of the material to be spun in each case. All those materials and elements as well as their alloys which possess a high lambda value are suitable for this, however some of them can be used with particular economy. Aluminum and zinc die-casting has proven to be excellent for this application, as a high degree of heat conductivity and the manufacturing economy of the die-casting process combine here.

To produce a soft yarn, protuberances (not shown) in the surface of the yarn draw-off nozzle touched by the yarn are provided. These protuberances "pluck" the yarn and thus produce a partial loosening of fibers from the peripheral layer of fibers and thus hairiness.

FIG. 2 shows protuberances in the form of ridges 7 in a top view. These may however also be made in form of ball-shaped or pin-shaped protuberances in the path of the yarn. Depending on the character of the yarn, different geometric shapes are suitable. There may also be different numbers of protuberances.

In FIG. 1 an insert 8 is shown in the path of the yarn or yarn draw-off channel 4, it being possible to subject the surface 81 of said insert 8 optionally to wear-protection measures. This insert 8 is made advantageously of steel. This is more advantageous than other solutions, e.g. ceramic, because steel can be produced more economically and allows for a wide range of surface treatments, each of which can be adapted to the particularities of the material to be spun. Thus a hardening of the insert is for example a low-cost, simple and effective measure for protection against wear.

The recesses in form of notches 6 made in the surface 21 of the outlet funnel 12 effectively cancel out the so-called false twist of the spun yarn 9 produced, among other factors, by the rotation of rotor 5 during spinning by causing a brief lifting of the yarn from the surface of the outlet funnel 12 and by thus giving the yarn the possibility to lose inner tensions.

The instant invention makes it possible to utilize more economical and longer-lasting yarn draw-off nozzles 1 in open-end spinning devices than formerly. By applying the object of the invention to materials specially suited for the different requirements such as wear resistance, corrosion resistance and heat conductivity and through their interaction it is possible to achieve a stable and constant spinning operation.

The instant invention is not limited to the embodiments shown here but may be made in further, appropriate embodiments.

It may be indicated for example to design yarn-guiding or yarn-contacting components of friction or air spinning devices or of other spinning devices in accordance with the instant invention.

We claim:

1. A heat dissipating yarn draw-off nozzle for use in an open-end spinning device, comprising:

an outlet piece, said outlet piece comprising a wear resistant material formed into a yarn contacting surface;

a wear resistant tubular insert disposed adjacent said outlet piece in the direction of yarn draw-off, said tubular insert comprising a substantially smooth inner surface;

a thermally conductive sleeve, said sleeve substantially surrounding and directly contacting said outlet piece and said tubular insert, said sleeve formed of a thermally conductive material having a heat conductivity lambda of at least 80 W/mk, said outlet piece in configuration with said insert and said sleeve defining a yarn draw-off channel through said nozzle; and wherein said sleeve is configured to be fitted directly into a rotor cover of the spinning device.

2. The nozzle as in claim 1, wherein said thermally conductive sleeve is formed substantially of aluminum.

3. The nozzle as in claim 1, wherein said thermally conductive sleeve is formed substantially of zinc.

4. The nozzle as in claim 1, wherein said outlet piece comprises a ceramic yarn contacting surface.

5. The nozzle as in claim 4, wherein the entire said outlet piece is comprised substantially of ceramic material.

6. The nozzle as in claim 4, wherein said outlet piece comprises a ceramic coating.

7. The nozzle as in claim 1, wherein said tubular insert is formed substantially of steel.

* * * * *